United States Patent [19]

Hughes

[11] Patent Number: 4,892,258

[45] Date of Patent: Jan. 9, 1990

[54] COMMINUTER FOR SOLID MATERIAL

[76] Inventor: John H. Hughes, 439 Monte Elma Rd., Montesano, Wash. 98563

[21] Appl. No.: 183,270

[22] Filed: Apr. 11, 1988

Related U.S. Application Data

[63] Continuation of Ser. No. 861,424, May 9, 1986, abandoned, which is a continuation-in-part of Ser. No. 635,213, Jul. 27, 1984, abandoned.

[51] Int. Cl.[4] ..... B02C 23/10

[52] U.S. Cl. ..... 241/79.3; 209/666; 241/188 R; 241/245; 241/253; 241/257 R; 241/261

[58] Field of Search ..... 241/89.1, 89.2, 286, 241/290; 209/660, 666

[56] References Cited

U.S. PATENT DOCUMENTS

| | | | |
|---|---|---|---|
| 759,856 | 5/1904 | Borton | 241/89.1 X |
| 1,125,137 | 1/1915 | Liggett | 241/89.1 X |
| 2,155,793 | 4/1939 | Komaki . | |
| 2,317,909 | 4/1943 | Gruendler | 241/89.1 X |
| 2,734,686 | 2/1956 | Oberhellmann | 241/82 |
| 3,166,301 | 1/1965 | Wootten . | |
| 3,356,016 | 12/1967 | Eidal . | |
| 3,658,262 | 4/1972 | Burant, Jr. . | |
| 4,009,836 | 3/1977 | Strom et al. | 241/73 |
| 4,366,928 | 1/1983 | Hughes . | |
| 4,477,028 | 10/1984 | Hughes . | |

*Primary Examiner*—Joseph M. Gorski

*Attorney, Agent, or Firm*—Christensen, O'Connor, Johnson & Kindness

[57] ABSTRACT

An improved comminuting device for pulverizing solid material includes a comminuting chamber and a discharge chamber adjacent the comminuting chamber. A screening assembly is located at the interface between the comminuting chamber and the discharge chamber and regulates the size of particles permitted to pass from the comminuting chamber into the discharge chamber. The screening assembly is adjustable to selectively vary the maximum size particles permitted to pass into the discharge chamber. The comminuting chamber is defined by a series of rolls having abrading protrusions on their outer surfaces. In one embodiment of the invention, the screening assembly includes a plurality of planar flails swingably mounted at a first end on a first surface of a disk rotatably mounted in the housing for rotaton in a horizontal plane. The disk forms the interface between the comminuting chamber and the discharge chamber. The flails extend beyond the periphery of the disk and spaces between the ends of the flails define openings through which the comminuted particles pass to the discharge chamber. By selectively limiting the degree of swinging movement of the flails, the size of the openings is limited so as to determine the maximum particle size that will pass into the discharge chamber. In another embodiment, the disk has a series of elongate fingers mounted on it. Each of the fingers is radially movable to vary the spacing between the end of the finger and the outer surface of the rolls.

15 Claims, 5 Drawing Sheets

10
14
12
15
13
16
20
20
30
24
26
43
34
40
28

Fig. 9.
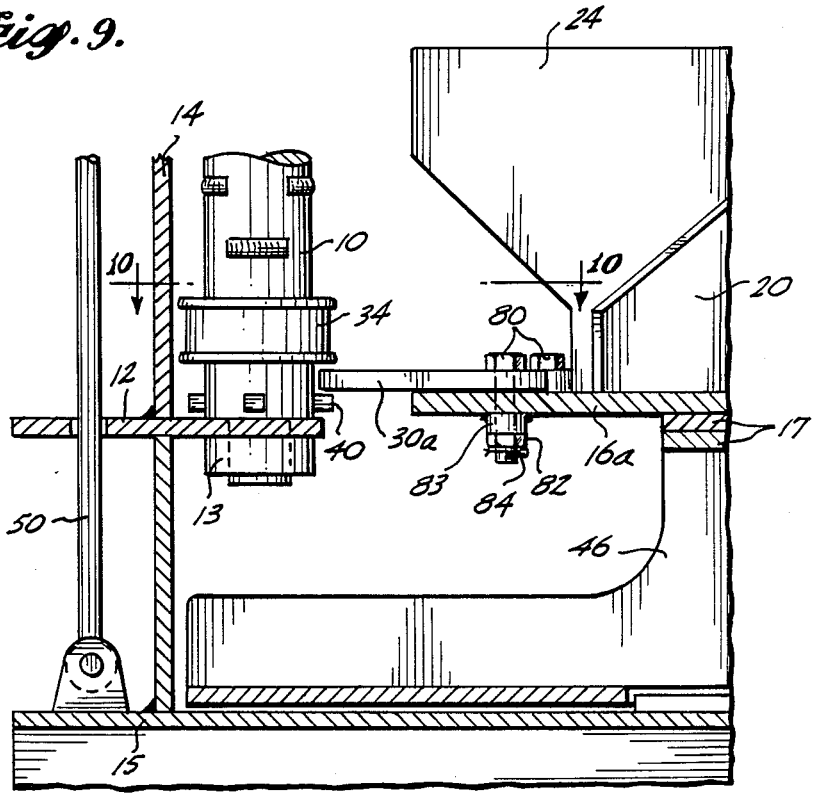
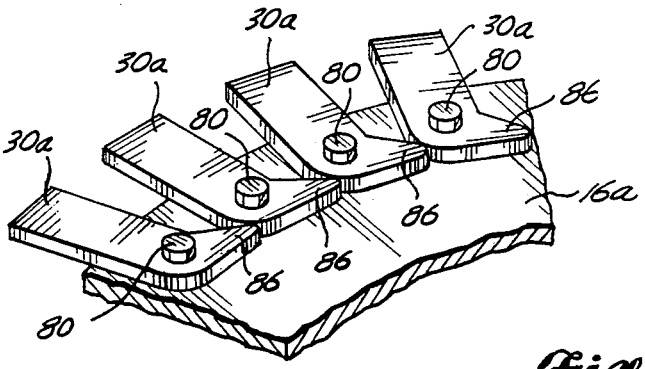
Fig. 8.

COMMINUTER FOR SOLID MATERIAL

This application is a continuation application based on prior copending application Ser. No. 861,424, filed May 9, 1986, now abandoned, which is a continuation-in-part of application Ser. No. 635,213, filed July 27, 1984, now abandoned.

BACKGROUND OF THE INVENTION

This invention relates to improvements in apparatus for comminuting solids such as wood, bark, rock, junk metal articles, et cetera. More particularly, it relates to improvements in the portions of the apparatus that handle the screening, sizing and sorting of the end product of the comminuter and an improved construction of the comminuter grinding rolls. This is a continuation-in-part of my copending application, Ser. No. 635,213, filed July 27, 1984.

In comminuters of the type described in my U.S. Pat. No. 4,366,928, in which a series of upright rolls define a comminuting chamber, it is desirable to provide an adjustable particle output size so that the same comminuter can be used with a minimum of adjustment for grinding and pulverizing various materials. It is an object of the invention herein to provide a screen means for screening the discharge from the comminuting chamber that is adjustable within a predetermined range to vary the size of output product of the comminuter from very fine particles to relatively large particles.

SUMMARY OF THE INVENTION

In accordance with the preferred form of the invention, the comminuter includes a series of upright rolls arranged to enclose a comminuting chamber, each of the rolls having teeth projecting therefrom, the rolls being driven to cause turbulent motion of materials placed within the comminuting chamber, so that the materials are pulverized by the repeated contact with one another and with the surfaces of the rolls. As the product moves in turbulent motion through the comminuting chamber, particles are moved by the force of gravity to the bottom of the chamber and an adjustable screening device is mounted at the bottom of the chamber. The screening device cooperates with the exterior walls of the comminuter housing to screen the particles according to size. Only those particles of a predetermined maximum size are permitted to exit the comminuting chamber and enter the discharge chamber located below the screening device. One embodiment of the screening device of the present invention includes a series of elongate movable fingers circumferentially arranged in radial orientation about the surface of a disk. The fingers are movably mounted on the disk so as to be adjustable to determine the maximum size particle that will be allowed to exit the comminuting chamber. A notch is preferably formed in a bottom plate of the comminuting chamber adjacent the screening member to facilitate the exit of fibrous materials that build up in clumps within the comminuting chamber. The preferred embodiment of the invention also includes a stationary tooth member projecting into the discharge chamber directly below the screening device to contact and sever any elongated pieces of material such as branches and twigs, to break them off and allow them to fall from the comminuting chamber to the discharge chamber without jamming of the screening device.

BRIEF DESCRIPTION OF THE DRAWINGS

The objects and advantages of the present invention will be better understood by those of ordinary skill in the art and others upon reading the ensuing specification taken in conjunction with the appended drawings wherein:

FIG. 8 is an isometric view of a portion of another embodiment of a screening device made in accordance with the principles of the present invention;

FIG. 9 is a side elevational view of a portion of a comminuter utilizing the screening device of FIG. 8;

DETAILED DESCRIPTION OF THE PREFERRED EMBODIMENT

Figure 1:
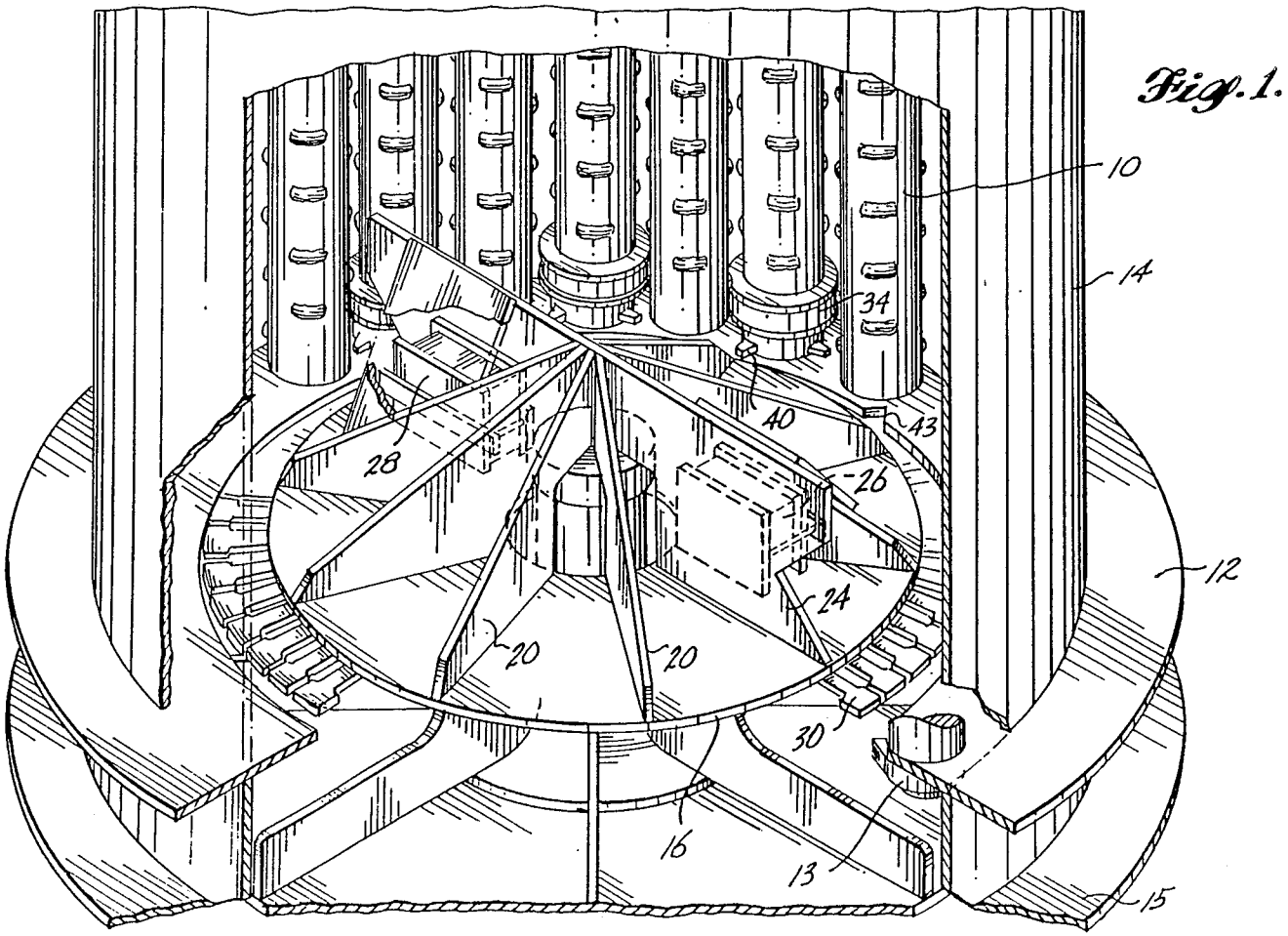
FIG. 1 is an isometric view of one embodiment of a comminuter with portions cut away to show one embodiment of a screening member made in accordance with the principles of the present invention mounted at the bottom of the comminuting chamber.

FIG. 1 illustrates a comminuter made in accordance with the principles of the present invention, and includes a series of elongated, upright comminuting rolls 10 that surround and define a cylindrical comminuting chamber. The rolls are mounted at a first end on a stationary base plate 12, and the entire assembly is surrounded by a housing 14. Each of the rolls is mounted on a bearing assembly 13 for rotational movement about its own axis. A second base plate 15 lies below the first base plate 12 spaced from the first base plate and defines the bottom of a discharge chamber, which lies directly below the comminuting chamber, to receive particles from the comminuting chamber. An extension of the housing 14 surrounds and encloses the discharge chamber. A screening disk 16 is positioned at the bottom of the comminuting chamber in the interface between the comminuting chamber and the discharge chamber and is bearing-mounted for rotation in a horizontal plane on a base post 18. A series of vanes 20 is arranged radially on an upper surface of the screening plate. In the illustrated embodiment, the vanes 20 are of essentially triangular shape, with the upper edge of the vane having its apex at the center of the comminuting chamber and converging as it extends toward the outer circumference of the screening disk. A vane plate 24 is vertically arranged across the screening plate essentially on the diameter of the screening plate, and has an essentially rectangular shape with notches cut out of each end of the vane plate. If desired, magnets 26 and 28, respectively, are mounted in the notches of the vane plate, to attract any metallic particles and separate them from the remaining particles when the comminuter is used to grind nonmetallic material such as bark and logs and scrap lumber.

A series of adjustable screening fingers 30 are mounted on the screening plate, and extend radially outward from the circumference of the screening plate toward the comminuting rolls 10. As will be described in greater detail below, each of the screening fingers is individually adjustable in a radial direction, to vary the spacing between the rolls 10 and the outer end of the screening finger so as to control the size of particles passing between the comminuting chamber and the discharge chamber. Each of the comminuting rolls 10 has a series of projections, designated teeth, which protrude from the exterior surface of the roll and assist in the grinding and tearing action of the comminuter on the materials within the comminuting chamber. The screening plate 16 is mounted on a base assembly 46 and rests on a stack of shims 17 that are interposed between the plate 16 and the base 46. By varying the number of shims 17 in the stack, the vertical position of the plate 16 can be varied. As the vertical position of the plate changes, the position of the edge of the screening assembly with relation to the rolls 10 and action disks 34 also changes. The vertical adjustability of the plate 16 on shims 17 therefore provides an additional control over the size of the passage from the comminuting chamber to the discharge chamber.

Figure 2:
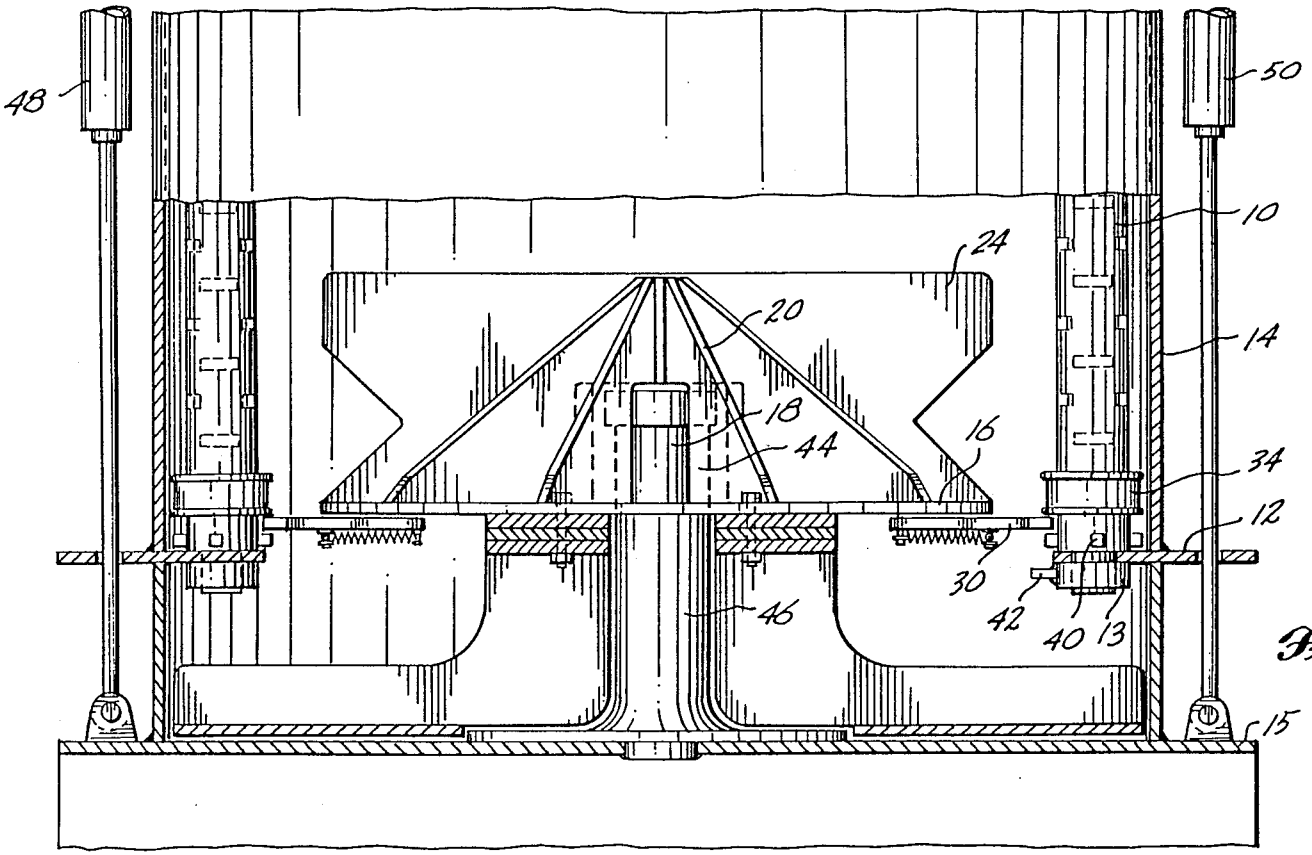
FIG. 2 is a side elevational view of the screening device and comminuting apparatus of FIG. 1.
Figure 3:
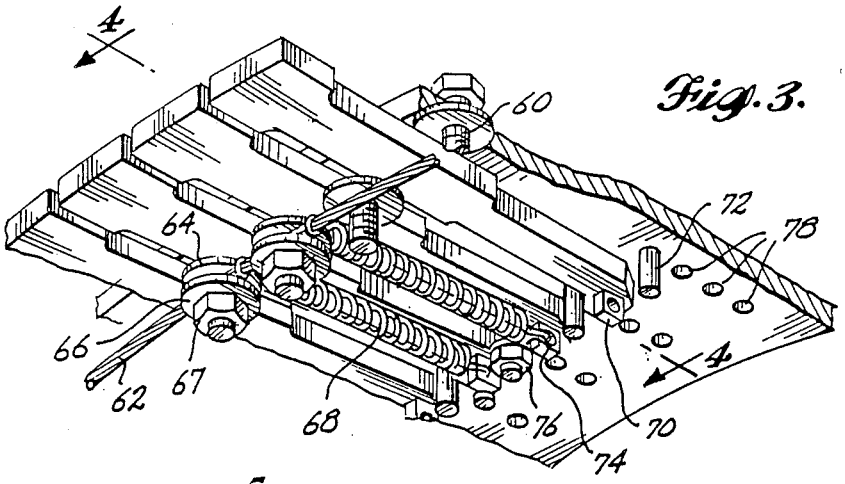
FIG. 3 is an isometric view of a portion of the screening device of FIG. 1.
Figure 4:
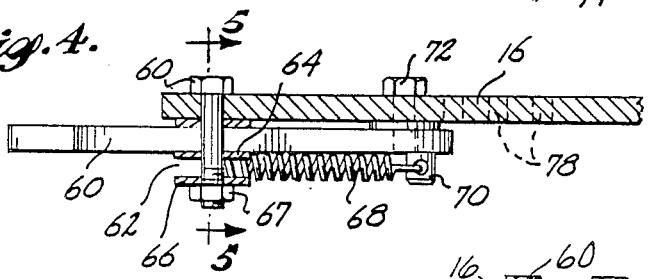
FIG. 4 is an elevational view in section taken along the line 4—4 of FIG. 3.
Figure 5:
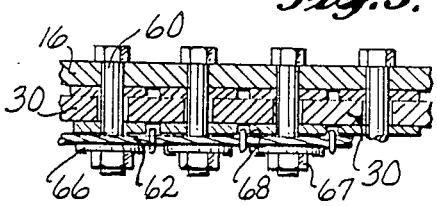
FIG. 5 is an elevational view in section taken along the line 5—5 of FIG. 4.
Figure 6:
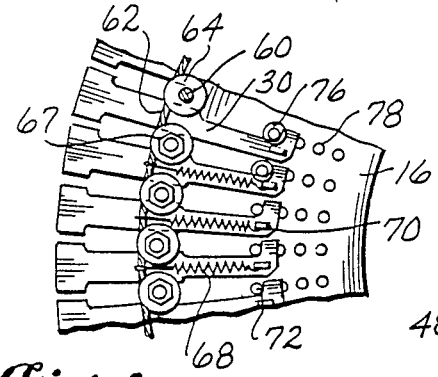
FIG. 6 is a plan view of the underside of the portion of the screening device shown in FIG. 3.

The basic operation of the comminuter is described in U.S. Pat. No. 4,366,928, issued Jan. 4, 1983, and also in my copending U.S. patent application Ser. No. 382,483, filed May 27, 1982, that has issued as U.S. Pat. No. 4,477,028 on Oct. 16, 1984. The basic operation of the comminuter involves rotating the comminuting rolls and feeding large pieces of material such as wood into the comminuting chamber. The rotating rolls cause a turbulent motion of the material within the chamber, and the interaction between the material and the toothed comminuting rolls pulverized and breaks the material into smaller and smaller pieces, the longer the material is within the comminuting chamber. The size of particles discharged from the comminuting chamber is determined by the size of the opening in the screening assembly between the comminuting chamber and the discharge chamber. In the present embodiment, by varying the position of the screening fingers, the size of the particles exiting the comminuting chamber can be varied, and until the particles reach that size, they will continue to move in turbulent motion within the comminuting chamber, being further reduced in size until they pass through the predetermined opening. To assist the particles in their turbulent motion, the screening disk can be rotated by an external source, or, alternatively, the swirling turbulent motion of the material impinging on the vanes 20 of the screening disk can be utilized to turn the screening disk without an independent power source. As can be seen in FIG. 2 in the illustrated embodiment, an action disk 34 is positioned at the base of alternate ones of the comminuting rolls and is of a diameter slightly larger than the comminuting rolls. The action disks turn in unison with the comminuting rolls, and provide additional assistance to the turbulent motion of the particles and material within the comminuting chamber. A series of clearing teeth 40 protrude from the comminuting rolls below the action disk and also in a position below the screening fingers. The clearing teeth perform the function of maintaining the opening between the screening fingers and the comminuting rolls free of congolmerations of particles, so that there is a free exit of particles from the comminuting chamber.

Sometimes a long piece of material such as a branch will become lodged within the space between the screening finger and the comminuting roll, causing a jam-up of particles exiting the comminuting chamber and possibly even stopping the motion of the rolls on the screening plate. A branch-clearing tooth 42 protrudes from the outer case of bearing assembly 13 associated with one of the rolls at a lowermost end thereof, and extends into the discharge chamber to break off any elongated pieces sticking down into the discharge chamber, so that they do not cause a jam between the screening disk or screening fingers and the comminuting rolls. Since the tooth 42 is attached to the bearing case 15, it does not rotate with the roll but remains stationary.

Visible in FIG. 1 is a notch formed in the baseplate 12. The notch 43, designated a woolly notch, is for allowing the passage of fibrous materials such as bark fibers from the comminuting chamber to the discharge chamber. The woolly notch is useful in configuration of the comminuter in which the screening plate is at the level of the baseplate 12 to prevent fibrous materials from clogging the passage between the comminuting chamber and the discharge chamber. Again referring to FIG. 2, the center spindle, on which the screening plate is mounted, is mounted on a bearing 44, which in turn is mounted in the base 46 of the unit. A pair of hydraulic actuators 48 and 50, respectively, are mounted between the comminuter housing 14 and the base 15 and are utilized to raise and lower the comminuter housing to permit access to the internal workings of the comminuter for repair and replacement of the rolls and other parts.

Turning now to FIGS. 3, 4, 5 and 6, the structure of the screening fingers and their mounting to the screening plate is more clearly illustrated. Each of the elongate screening fingers 30 underlies the screening plate 16 and the long dimension of the screening finger is radially oriented with respect to the screening plate. A series of bolts 60 is arranged in a circle about the outer perimeter of the screening plate protruding through the top surface of the plate and extending from the bottom of the plate. The screening fingers 30 are located between the bolts arranged circumferentially around the screening disk. A cable 62 surrounds the outer edge of the bolts and washers 64 are placed between the cable and the screening fingers. The washers 64 are wide enough to overlap adjacent screening fingers and serve to hold the screening fingers between the cable and the screening plate. Each bolt 60 has a second washer 66 associated with it and the cable 62 is sandwiched between the washers. Each bolt 60 has a nut 67 threadably engaging it to hold the washers and cable in place. Each finger 30 has associated with it a coil spring 68. The cable forms an anchor point for one end of each of the coil springs 68. The other end of each of the springs is hooked onto one of a plurality of eye members 70 extending downwardly from the inward end of each of the screening fingers. Each spring 68 places a bias force in the radially outward direction on its associated screening finger. The inward end of each screening finger is formed with a shoulder, which cooperatively engages an associated second bolt 72, which protrudes through holes formed in the screening plate intermediate each of the screening fingers along a circle located radially inward of the location of first bolts 60. The cooperation between the shoulder at the end of the screening finger and the bolt 72 keeps each of the screening fingers from moving radially outward in response to the bias force of its associated spring. A second series of washers 74 and nuts 76 are mounted on each of the second series of bolts 72 to keep the screening fingers oriented horizontally and flat against the underside of the screening plate 16. The position of each of the second bolts 72 determines the radial position of its associated screening fingers and therefore determines the spacing between the outer ends of the screening fingers and the rolls 10. The particle size allowed to pass between the comminuting chamber and the discharge chamber is therefore dependent upon the positioning of the screening fingers relative to the rolls which in turn is determined by the position of the second bolts 72. Typically, a series of holes 78 will be formed along radial lines in the screening disk so that the position of each individual screening finger can be varied to predetermined positions by placement of the second bolt 72 associated with each of the fingers 30 into the appropriate one of holes 78 as dictated by the desired opening size for particles passing between the comminuting chamber and the discharge chamber. While the illustrated embodiment utilized a spiral expansion spring to bias the screening teeth in the radially outward direction, any suitable spring arrangement can be used to accomplish the same purpose of outwardly biasing the screening teeth.

One advantage to utilizing the screening tooth and spring arrangement is that since the spring biases the fingers in an outward direction and the notch and bolt arrangement restrains movement only in the outward direction, there is some yieldability of the fingers in the inward direction. This yielding ability allows the fingers to move in the event that a large piece of metal is in the comminuting chamber and lodges itself in the opening to the discharge chamber. The yieldability of the fingers will allow the metal to dislodge the finger and widen the opening, allowing it to pass into the discharge chamber without causing a jam of the comminuting rolls or the screening assembly, and minimizing any possibility of serious damage to the equipment.

Figure 7:
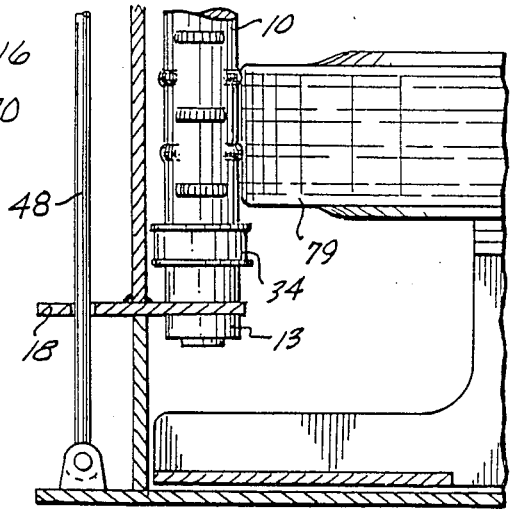
FIG. 7 is a side elevational view of a portion of an alternate embodiment of the comminuting device of FIG. 1, showing an inflatable member used as a screening device.

FIG. 7 illustrates an alternate screening arrangement to the screening teeth and screening plate illustrated in FIGS. 1–6. FIG. 7 illustrates a pneumatic annular screening member 79 which is oriented for rotation in a horizontal plane on the baring spindle at the center of the comminuter. By varying the inflation of the pneumatic annular member, a varying spacing between the annular member and the exterior surface of the comminuting rolls can be obtained, thereby providing a variation in size of the opening between the comminuting chamber above the member and the discharge chamber below the member. In a presently operative embodiment of the invention, the annular screening member is a tire, which is inflated and placed for horizontal rotation within the chamber. It has been found that the use of the pneumatic screening member is especially helpful in comminuting stringy material such as cedar and spruce bark. The tire acts as a flexible anvil in relation to the comminuting roll, and while most grinding is done in the main portion of the comminuting chamber, there is a certain amount of finish grinding that is accomplished between the tire and the comminuting rolls that finally grinds the particles to the size at which they will pass between the comminuting chamber and the discharge chamber.

Yet another embodiment of a screening device made in accordance with the present invention is shown in FIGS. 8–12. The screening device comprises a series of flails **30*a* pivotally mounted on the screening disk 16*a* as shown in FIG. 8. The flails 30*a* comprise flat plates that rest on top of the screening plate 16*a* and are held in place by a fastener such as bolt 80 which passes through the first end of the flail and a hole formed in the plate 16*a*. The bolt is held captive by a nut 82 threadably engaging the bolt and then to ensure that the nut does not come loose from the bolt during operation of the comminuter, a cotter pin 84 can be placed through the bolt as it extends beyond nut 82**.

The bolt 80 and nut 82 are not tightened to the point of tightly holding the flail **30*a* on place on the plate 16*a*, but rather are loose enough to permit the flail 30*a* to swing about the bolt over the upper surface of the plate 16*a* as the plate 16*a* turns during the comminuting operation. A plurality of bosses 83 are formed beneath the plate 16*a* to space the nut 82 from the plate. As can best be seen in FIG. 9, the flails 30*a* extend in their radially extended position almost to the outer surface of the roll 10 and fit in the space below the action disk 34 and above the clearing teeth 40. The actual size of each of the flails is determined by the particular dimensions of the comminuter in which it is to be used and also the size of particles which are to be discharged from the comminuting chamber to the space below the screening disk 16*a*. Each of the flails 30*a* has a projecting footpiece 86 extending in dog-leg fashion from the first end of the flail. The swinging movement of the flails is limited by engagement of the footpiece 86 with the adjacent flail. The degree to which the flails can move is determined by the size and shape of the foot pieces 86 that extend from each flail. By controlling the magnitude of the swinging movement of the flails 30*a*, the particle size of comminuted particles that will pass from the comminuting chamber to the discharge chamber will be controlled. Therefore, the size of the flails and the size of the foot which limits the swinging movement of the flail are chosen to provide the desired particle size. Therefore, the swinging flails 30*a* provide a variable screening function similar to the movable fingers 30** described earlier.

Figure 10:
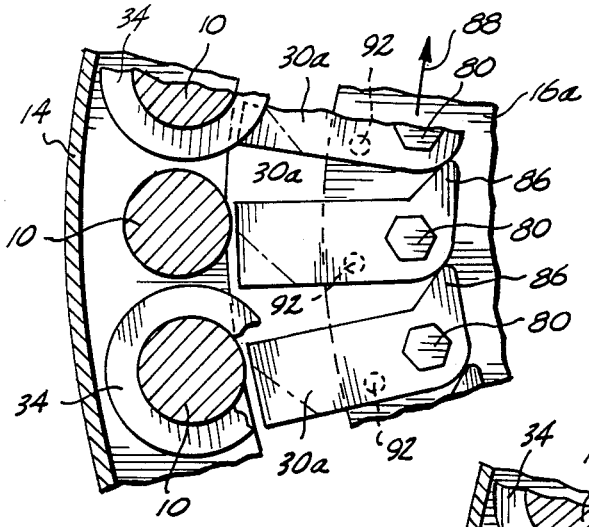
FIG. 10 is a plan view of a portion of the comminuter of FIG. 9 showing a portion of the screening device of FIG. 8.
Figure 11:
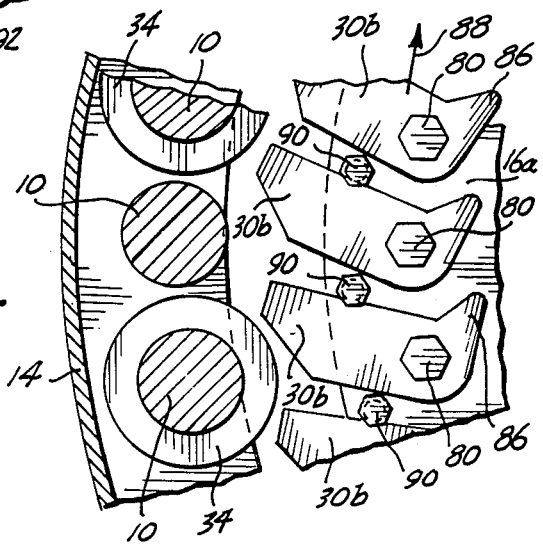
FIG. 11 is a plan view of the portion of the comminuter of FIG. 10 showing a modification of the screening device of FIG. 8; and, FIG. 12 is a plan view of the portion of the comminuter of FIG. 10 showing another modification to the screening device of FIG. 8.

FIG. 10 is a plan view of the screening disk **16*a* with flails 30*a* mounted thereon showing the relationship of the flails to the comminuting rolls as the screening disk 16*a* turns in the direction of arrow 88. FIG. 11 shows an alternate chamfered shaped to the flails 30*b* in which each flail has a corner cut from the second end of the flail to allow larger size particles to be passed from the comminuting chamber to the space below the screening disk 16*a*. Also, movement of the flails is limited in the embodiment of FIG. 11 by pins 90 mounted in holes 92 formed in the screening disk 16*a*. The pins are placed between adjacent flails and as the screening disk turns, the flails will abut the pins 90** and are constrained between the pins.

Figure 12:
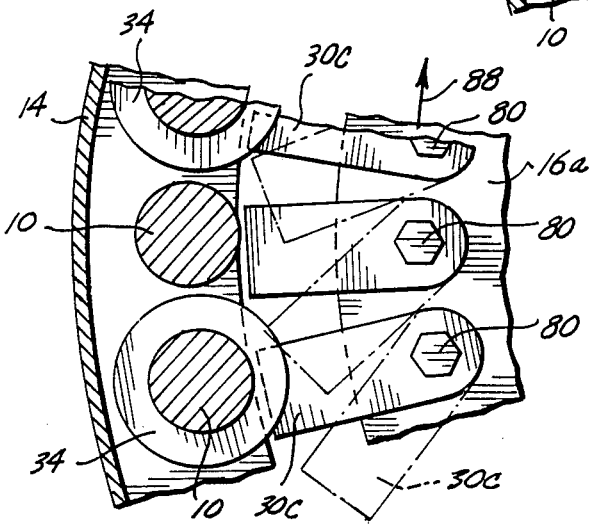

FIG. 12 shows a series of flails **30*c* that are neither constrained by pins, as in the embodiment of FIG. 11, nor provided with feet to limit the flail movement, as in the embodiment shown in FIGS. 8 and 10. As shown in phantom line in FIG. 12, as the screening disk 16a rotates in the direction of the arrow 88, the flails will move from their stationary position shown in solid line, to the position shown in phantom line. By monitoring the speed of the disk 16a and the size of the flails 30c, the proper disk speed and flail size for a desired particle size can be determined to provide the appropriate screening action of the flails in screening disk 16a. The flails 30a, 30b and 30c are shown mounted on the upper surface of the screening disk 16a so that the upper surface of the screening disk provides a bearing surface for the flails so that the vertical load of the flails does not have to be supported solely by the bolt 80 and nut 82. It would be possible from the point of achieving suitable screening action to mount the flails on the undersurface of the screening disk 16a. However, then the life of the flails and the life of the bolts 82 can be significantly reduced because of the loads placed on the bolt 82**, which is the sole support for vertical forces on the flails.

In certain environments, it is desirable to tighten bolts and nuts 80 and 82 sufficiently to hold the flails 30 in a stationary position even during rotation of the screening disk 16a. The particle size will be determined by the spacing between the end of the flail and the rolls 10 and action disk 34. If a change in particle size is desired, it is necessary to replace the flails with ones of different length or end shape or to adjust the vertical position of the screening disk 16a by addition or removal of shims 17. The stationary flail screening assembly, does have a long wear life. Since each flail is individually replaceable, repairs are easier and less expensive than in the case of a solid, formed screening disk of the type described in may U.S. Pat. No. 4,477,208.

In summary, therefore, an improved comminuting device for grinding and pulverizing solid materials has been described and illustrated. The improved comminuting device includes a screening member positioned between the comminuting chamber and the discharge chamber to regulate the size of particles exiting in the comminuting chamber. The screening member is adjustable to selectively vary the size of particles permitted to exit the comminuting chamber. Changes can be made in the illustrated embodiment of the adjustable screening member, for example, the placement of the spring can be varied and the use of a compression rather than expansion spring can be substituted, while remaining within the confines of the invention. Also, the degree to which the corners of the free swinging flails are cut can be varied over a large range. The exact configuration of the flails or the stops used to limit movement of the flails is to be determined by the requirements of the desired particle size and the material being comminuted. Therefore, the invention should not be considered limited by the illustrated and described embodiments and those should be considered as exemplary only. The invention should be defined solely by reference to the appended claims.

The embodiments of the invention in which an exclusive property or privilege is claimed are defined as follows:

1. In an apparatus for comminuting solid materials to form particles, including a housing defining a comminuting chamber, said comminuting chamber formed by a series of comminuting rolls arranged within said housing, said housing further defining an adjacent discharge chamber, screening means located at an interface between said comminuting chamber and said discharge chamber, said screening means including a disk horizontally mounted within said housing for free rotation in a horizontal plane, said disk having a peripheral edge spaced from said comminuting rolls to define therebetween a size restriction passage for particles moving from said comminuting chamber to said discharge chamber, a series of screening members mounted on said disk independently of one another, a first portion of each of said screening members extending past said peripheral edge of said disk into said size restriction passage, and means for positioning each screening member relative to each other screening member past said peripheral edge of said disk so as to allow independent selective variation of the size of said first portion of each said screening members extending past said peripheral edge of said disk.

2. The apparatus of claim 1, wherein each of said screening members is individually movable in a radial direction independent of the remaining screening members.

3. The apparatus of claim 2, wherein each of said screening members is resiliently biased in an outwardly radial direction.

4. The apparatus of claim 3, wherein said screening means further includes constraint means mounted on said disk and cooperable with said screening members to restrain the movement of said screening members in an outwardly radial direction.

5. The apparatus of claim 4, wherein one of said constraint means is associated with each of said screening members and said constraint means are each selectively positionable on said disk at a predetermined number of locations so as to permit adjustment of said screening members in a predetermined number of locations.

6. The apparatus of claim 1, wherein said screening means further includes a plurality of generally radial vanes vertically oriented and affixed to an upper surface of said disk, such that said vanes extend into said comminuting chamber.

7. The apparatus of claim 6 further including a magnet mounted on at least one of said vanes.

8. The apparatus of claim 1, wherein said screening members comprise elongate planar flails swingable mounted at a first end thereof on a first surface of said disk,.

9. The apparatus of claim 8 further including limit means associated with each of said flails to limit the extent of swinging movement of each flail.

10. The apparatus of claim 9, wherein said limit means comprises a plurality of studs fixed to said first surface of said disk intermediate said flails, said flails abutting said studs as the disk rotates.

11. The apparatus of claim 9, wherein said limit means includes a foot integrally formed with said first end of each of said flails, said foot extending from said flail and constructed and arranged such that as said disk rotates, said foot of each flail abuts the adjacent flail to limit the swinging movement of said flails.

12. The apparatus of claim 9, wherein a second end of each flail is chamfered.

13. The apparatus of claim 8, wherein said first surface of said disk is an upper surface and said first surface provides a bearing surface for said flails as they experience their swinging movement.

14. The comminuting apparatus of claim 1 further including a stationary branch-breaking tooth member associated with said housing and extending horizontally into said discharge chamber below said screening means.

15. The comminuting apparatus of claim 1 further including a baseplate extending horizontally from said housing at the interface of said discharge chamber and said comminuting chamber, said baseplate having an aperture centrally formed therein defined by a first edge, said screening means lying inwardly of said first edge, said first edge having a notch formed therein to assist in the passage of fibrous material from said comminuting chamber to said discharge chamber.

* * * * *